US006094765A

United States Patent [19]

Askenase

[11] Patent Number: 6,094,765

[45] Date of Patent: Aug. 1, 2000

[54] DEVICE FOR CLEANING TOILET BOWLS AND OTHER DRAINS

[76] Inventor: Matthew A. Askenase, 100 Oxford Dr., Monroeville, Pa. 15146

[21] Appl. No.: 09/110,364

[22] Filed: Jul. 6, 1998

[51] Int. Cl.[7] ..... B08B 9/00; B08B 9/02

[52] U.S. Cl. ..... 15/104.05; 15/104.33

[58] Field of Search ..... 15/104.001, 104.03, 15/104.05, 104.16, 104.31, 104.32, 104.33; 294/15

[56] References Cited

U.S. PATENT DOCUMENTS

| | | | |
|---|---|---|---|
| 507,435 | 10/1893 | Helfensteller | 15/104.33 |
| 1,375,088 | 4/1921 | Fries | 15/104.05 |
| 1,825,851 | 10/1931 | Bropson | 15/104.33 |
| 1,858,997 | 5/1932 | Lewin | 15/104.33 |
| 2,610,854 | 9/1952 | Enderle et al. | 294/15 |
| 3,858,848 | 1/1975 | MacFetrich | 15/104.33 |
| 5,666,683 | 9/1997 | Gairdner | 15/104.001 |
| 5,765,251 | 6/1998 | Jones | 15/104.33 |

*Primary Examiner*—Terrence R. Till
*Attorney, Agent, or Firm*—H. Keith Hauger, Esq.

[57] ABSTRACT

A device for cleaning toilet bowls and other drains which consists of a rod of a specific configuration. At one end of the rod is located an angled prong which is maneuvered into a passageway of a toilet bowl or any type of drain to engage and remove obstructive objects. At the other end of the rod is located a handle for grasping the rod for the purpose of firmly holding this device in the process as outlined.

4 Claims, 3 Drawing Sheets

DEVICE FOR CLEANING TOILET BOWLS AND OTHER DRAINS

BACKGROUND OF THE INVENTION

1. Field of the Invention

The present invention relates to a device for cleaning toilet bowls and other drains, and more particularly, to removing toilet paper, debris, sanitary napkins and other obstructions from a toilet flush passageway in a toilet bowl.

2. Description of the Prior Art

Plumbers, maintenance personnel, landlords, commercial real estate owners and individual homeowners are all aware of the difficulty encountered in locating and removing all the various objects which become lodged or clogged in toilet bowls, drain pipes, tubes and the like. The prior art discloses a variety of snake-like devices, suction-like plungers, brushes and other apparatus for the defined purpose. Mockel U.S. Pat. No. 4,253,211 entitled "Toilet Bowl Cleaning Apparatus" discloses a hooked weight attached by a line or cable to a swab whereby a toilet bowl is removed from its mounting and inverted allowing the weighted end to be inserted for removal of the described debris.

A drawback to some or all of the above-known methods and/or designs is that a great deal of time must be expended and the use of some of the prior art tools are ineffectual. Thus, there is a need in the industry for providing a very simple, manageable tool that may be readily used by a workman at the site of the described problem. Therefore, it is an object of the present invention to satisfy this need in the industry and to overcome the above disadvantages of the present methods and designs for removing foreign objects from toilet bowls and other drains.

SUMMARY OF THE INVENTION

It is, therefore, an object of the present invention to provide a device for cleaning toilet bowls and other drains that is simply constructed and cost efficient to produce.

It is the further object of the present invention to provide a device capable of extending into a toilet bowl passageway, drain or pipe for easy dislodging and removal of all types of obstructions.

It is the further object of the present invention to provide a device capable of being utilized without removing the toilet bowl from its mounting.

It is the further object of the present invention to provide a device that is easy to clean subsequent to its use making same ready for immediate re-use.

It is the further object of the present invention to provide a device that is durable and will not cause damage to porcelain toilet bowls and other materials which may be subject to scratching and/or chipping.

It is the further object of the present invention to provide a device that represents a substantial improvement to the particular art of retrieving obstructive materials from clogged and impeded toilet drains and the like.

More particularly, it is the object of the present invention to provide a device for cleaning toilet bowls and other drains comprising a dimensioned rod having an engagement means at a first end for engagement to wadded toilet paper, debris and the like causing blockage in said toilet bowls and other drains, having a grasping means at a second end for firmly holding said device in the process of removing said wadded toilet paper, debris and the like.

These and the other objects, features and advantages of the present invention will become more fully apparent from the following detailed Description of the Preferred Embodiment, the appended Claims, and the accompanying drawings appended hereto.

BRIEF DESCRIPTION OF THE DRAWINGS

For a better understanding of the invention, reference may be had to the accompanying drawings in which.

DETAILED DESCRIPTION OF PREFERRED EMBODIMENTS

Figure 1:
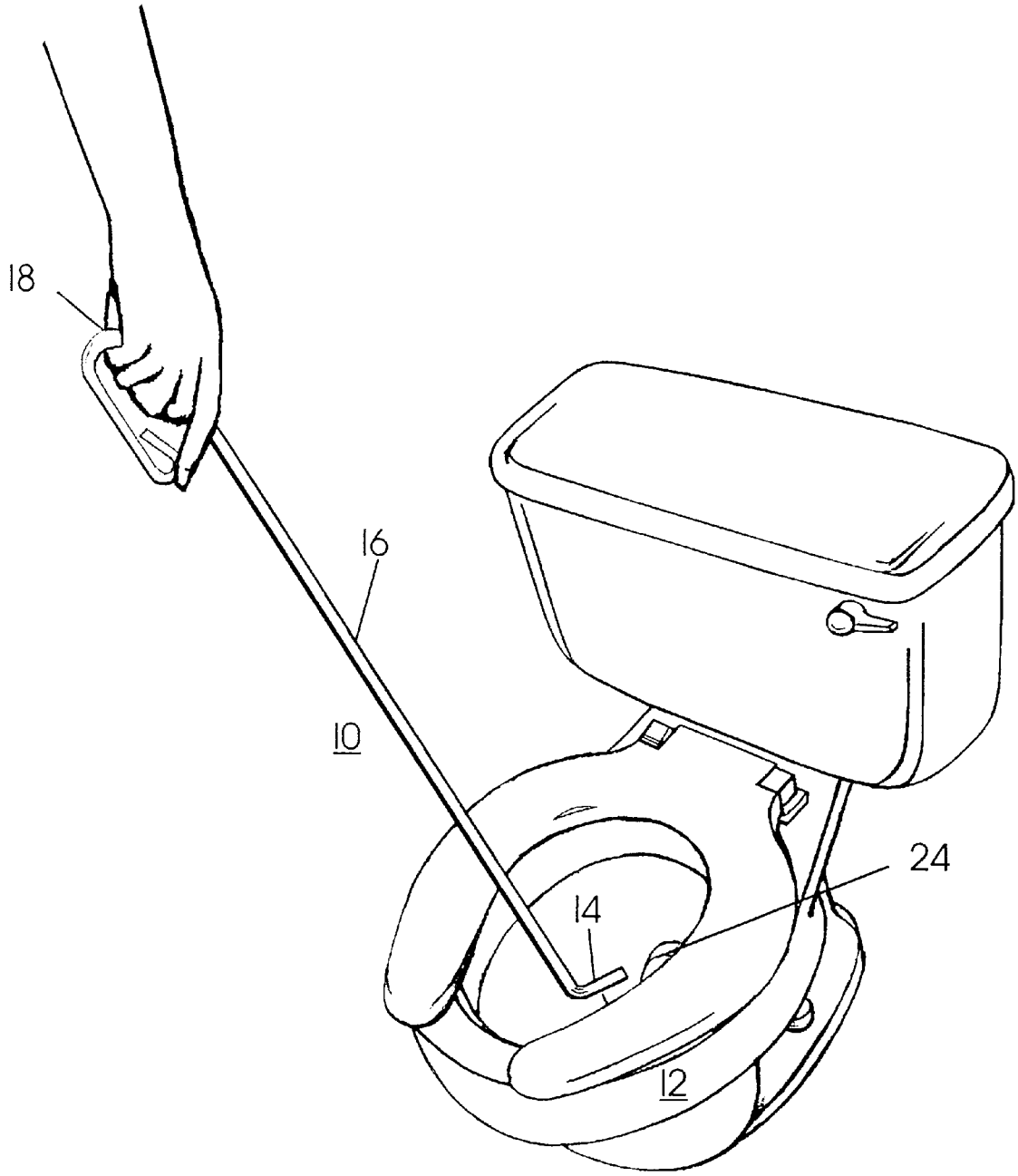
FIG. 1 is a perspective view illustrating the present invention in practical use.

Referring to the drawings, FIG. 1 represents a perspective view of a device for cleaning toilet bowls and other drains 10 in actual use. A device for cleaning toilet bowls and other drains 10 is inserted into a toilet bowl passageway 24 of toilet bowl 12 wherein is located wadded toilet paper, debris and the like which causes blockage to toilet bowl passageway 24. A device for cleaning toilet bowls and other drains 10 consists basically of elongated stem member 16 with prong member 14 at one end and u-shaped handle 18 at the other end. The process of use is simple involving grasping the unshaped handle 18 and extending device for cleaning toilet bowls and other drains 10 at prong member 14 into toilet bowl passageway 24 where prong member 14 engages to wadded toilet paper, debris and the like.

Figure 2:
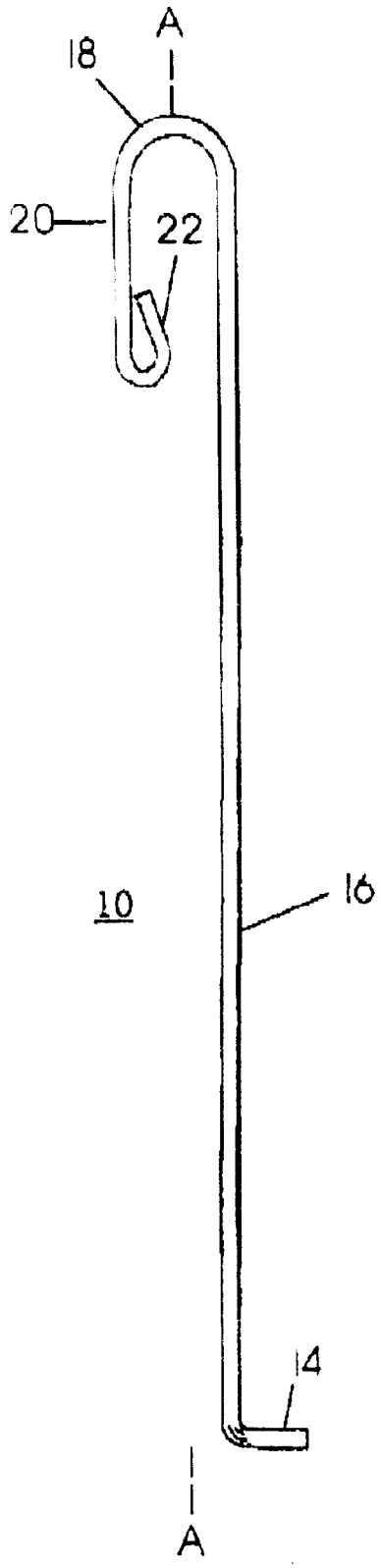
FIG. 2 is a side view of a device for cleaning toilet bowls and other drains.
Figure 3:
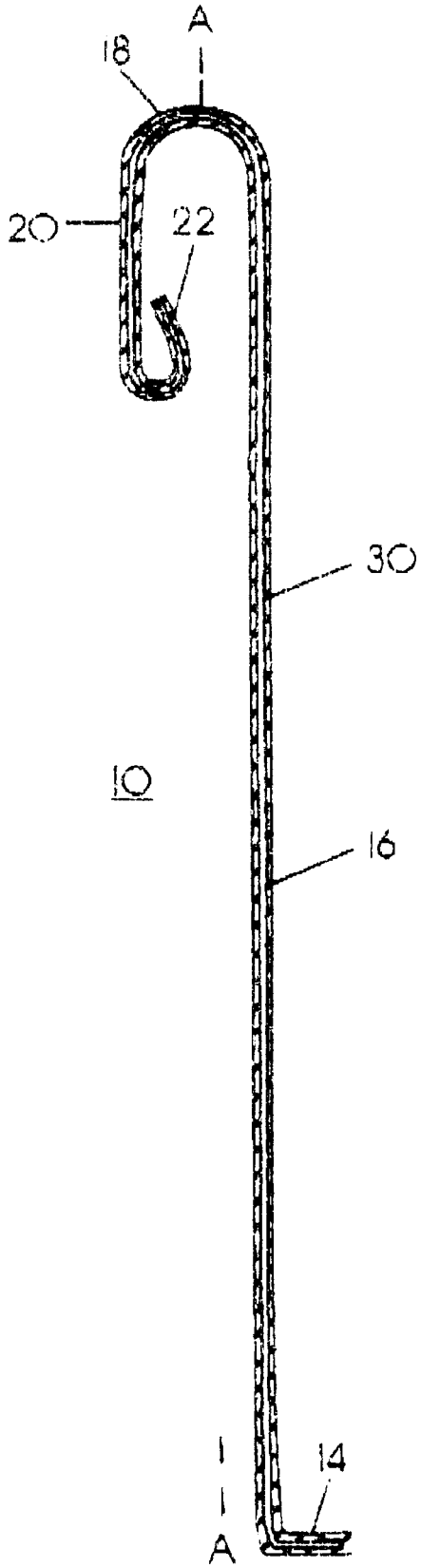
FIG. 3 is a side sectional view cut along line 3—3 of a device for cleaning toilet bowls and other drains coated with a plastic-like material.

Further details of a device for cleaning toilet bowl 10 are viewed in FIG. 2. Specifically, unshaped handle 18 consists of shank grip 20 and crimped end 22 which enables a person's hand to readily and easily grasp unshaped handle 18 and maneuver device for cleaning toilet bowls and other drains 10 in order to remove the subject obstruction from toilet bowl 12. The obstructive material may then easily be shaken from device for cleaning toilet bowls and other drains 10 and disposed of in a sanitary fashion.

The subject device for cleaning toilet bowls and other drains is preferably constructed from a lightweight wire gauge which is coated with a plastic-like material 30 to avoid scratching and breakage to porcelain materials from which toilet bowl 12 is most likely to be constructed. The particular wire gauge would be selected to allow a minor degree of flexibility to a device for cleaning toilet bowls and other drains 10 when inserted into the toilet bowl passageway 24 which often curves depending on the construction of toilet bowl 12.

In accordance with the provisions of the patent statutes, I have explained the principle and operation of my invention and have illustrated and described what we consider to represent the best embodiment thereof.

I claim:

1. A device for cleaning toiler bowls and other drains comprising:

a dimensioned rod having an engagement means at a first end, wherein said engagement means consists of a prong angular to and integral to said dimensioned rod, said engagement means for engagement to wadded toilet paper and debris causing blockage in said toilet bowls and other drains;

a grasping means consists of a u-shaped member integral to said dimensioned rod, wherein said grasping means is located at a second end of said dimensioned rod for firmly holding said device in the process of removing said wadded toilet paper and debris.

2. A device for cleaning toilet bowls and other drains according to claim 1, wherein said unshaped member comprises a shanked grip crimped at an end of said shanked grip.

3. A device for cleaning toilet bowls and other drains according to claim 4, wherein said dimensioned rod is plastic coated to prevent scratching, chipping and other damage to said toilet bowls and other drains.

4. A device for cleaning toilet bowls and other drains according to claim 3, wherein said dimensioned rod is constructed to flex allowing said device for cleaning toilet bowls and other drains to conform to the curves of a toilet bowl passageway in said toilet bowl.

* * * * *